US005469681A

United States Patent [19]

Wu

[11] Patent Number: 5,469,681

[45] Date of Patent: Nov. 28, 1995

[54] VINYL CEILING GRID STRUCTURE

[76] Inventor: Ming-Hsin Wu, 20, Lane 92, Shing E11 Street, Tao Yuan City, Tao Yuan County, Taiwan

[21] Appl. No.: 207,685

[22] Filed: Mar. 9, 1994

[51] Int. Cl.[6] ..... E04B 9/24

[52] U.S. Cl. ..... 52/656.9; 52/506.07; 52/506.08; 52/506.09; 52/665; 52/668; 52/669; 403/174; 403/178; 403/217; 403/218

[58] Field of Search ..... 52/656.9, 506.07, 52/506.08, 506.09, 665, 668, 669; 403/174, 178, 217, 218

[56] References Cited

U.S. PATENT DOCUMENTS

| | | | |
|---|---|---|---|
| 3,677,589 | 7/1972 | Roles | 52/506.07 X |
| 4,583,340 | 4/1986 | Sauer | 52/506.07 |
| 4,744,188 | 5/1988 | Ahren | 52/506.07 |
| 5,046,294 | 9/1991 | Platt | 52/665 X |

*Primary Examiner*—Carl D. Friedman
*Assistant Examiner*—Christopher Todd Kent
*Attorney, Agent, or Firm*—Bacon & Thomas

[57] ABSTRACT

A vinyl ceiling grid structure for supporting ceiling panels comprising a two-way connecting member, a one-way connecting member, an angled slat, an inner angled plate, an outer angled plate and a receiving base. Each of these components is formed integrally with plastics and can be selectively assembled together to form a grid system. The one-way and the two way connecting members are provided for the connection of the partitioning board to form the grid structure suspended in the ceiling. The angled plates can either be selected from the inner type or the outer type depending on the application. The receiving base is inserted at the end of the partitioning board so as to be able to connect to the angled slat, forming the vinyl ceiling grid structure for supporting the ceiling panels.

10 Claims, 6 Drawing Sheets

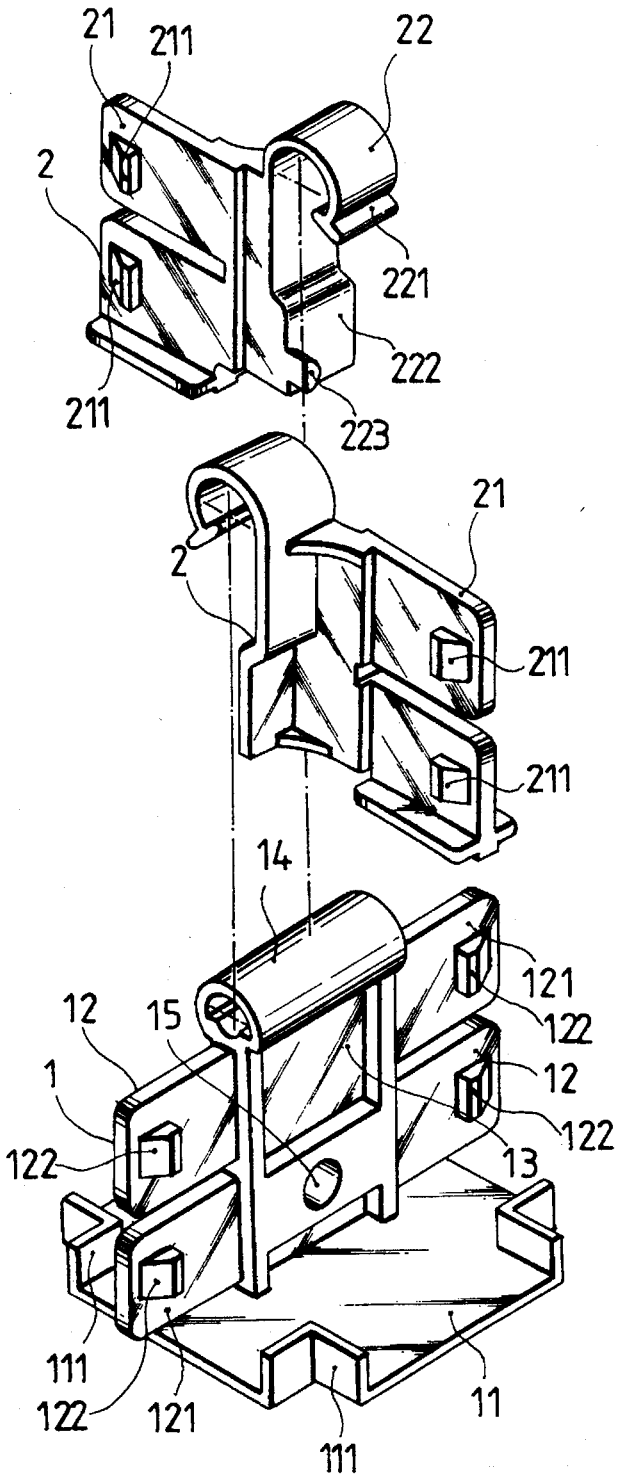
FIG, 2

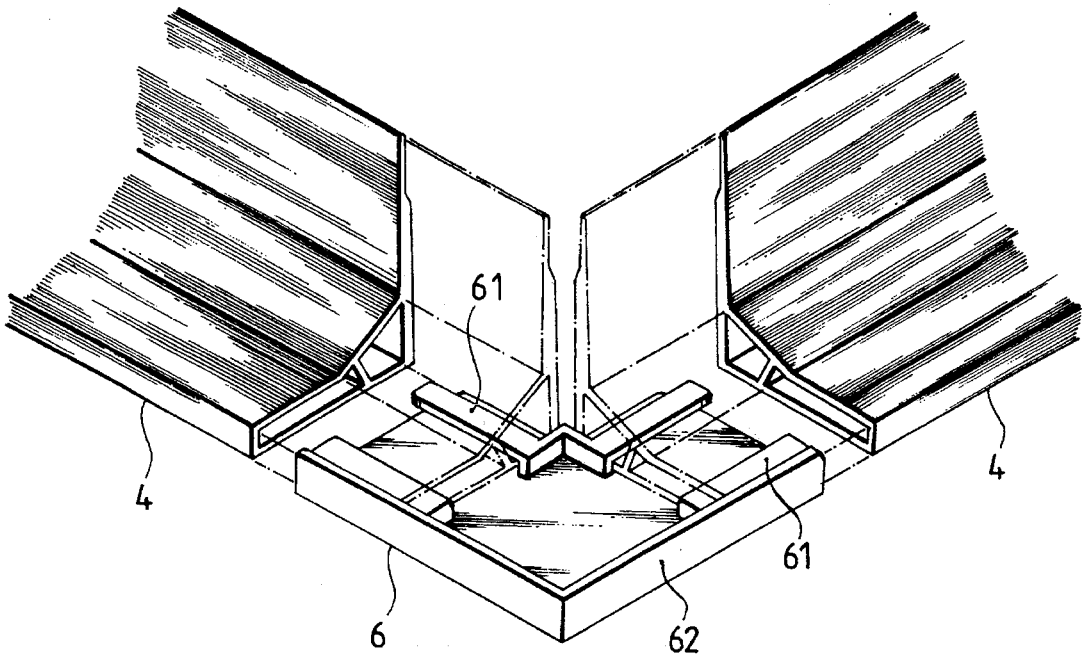
FIG, 4
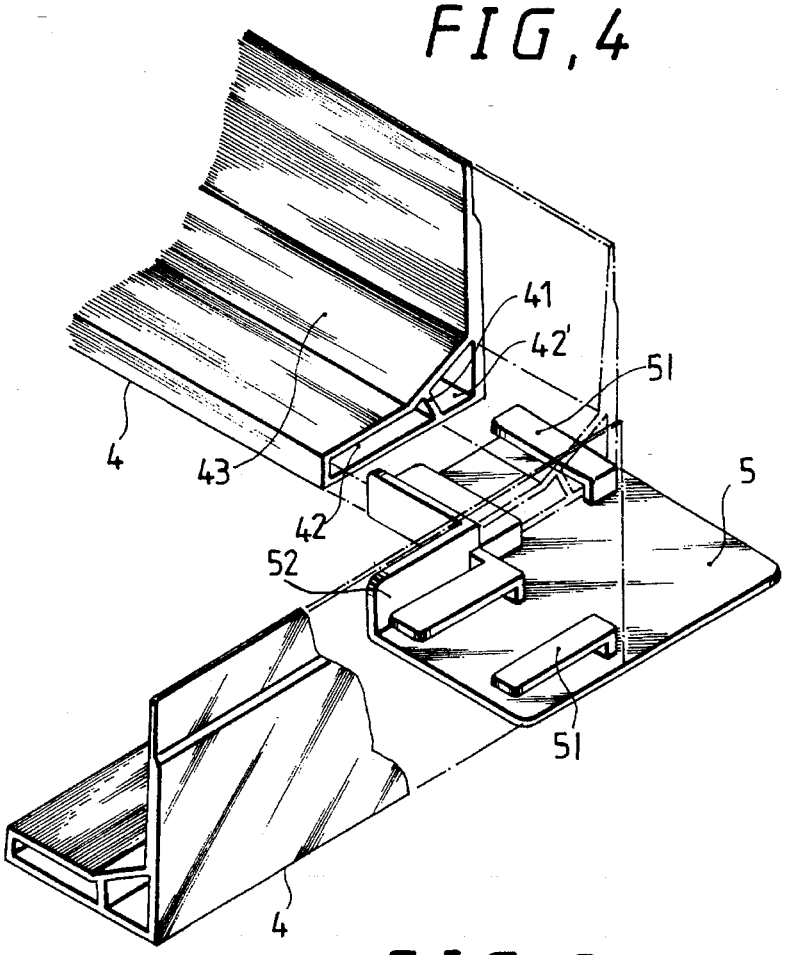
FIG, 3

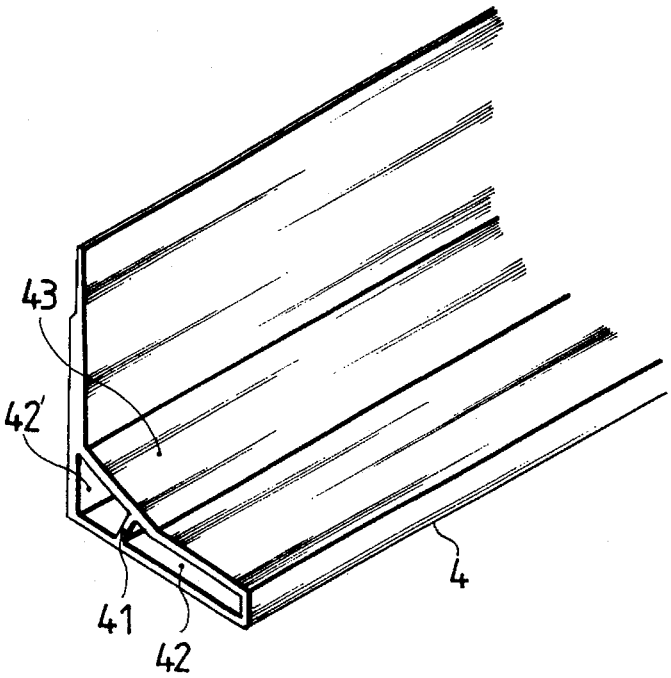
FIG, 5
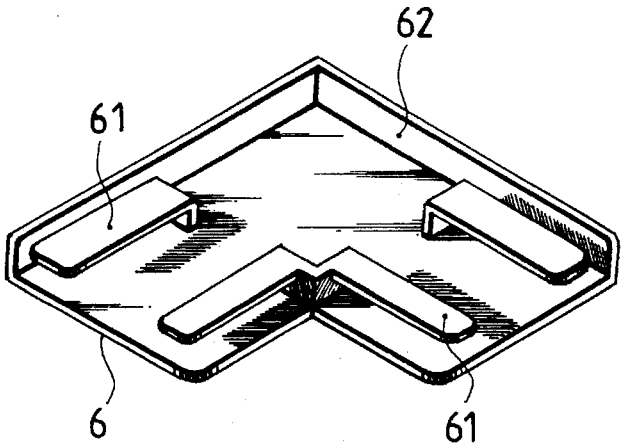
FIG, 6

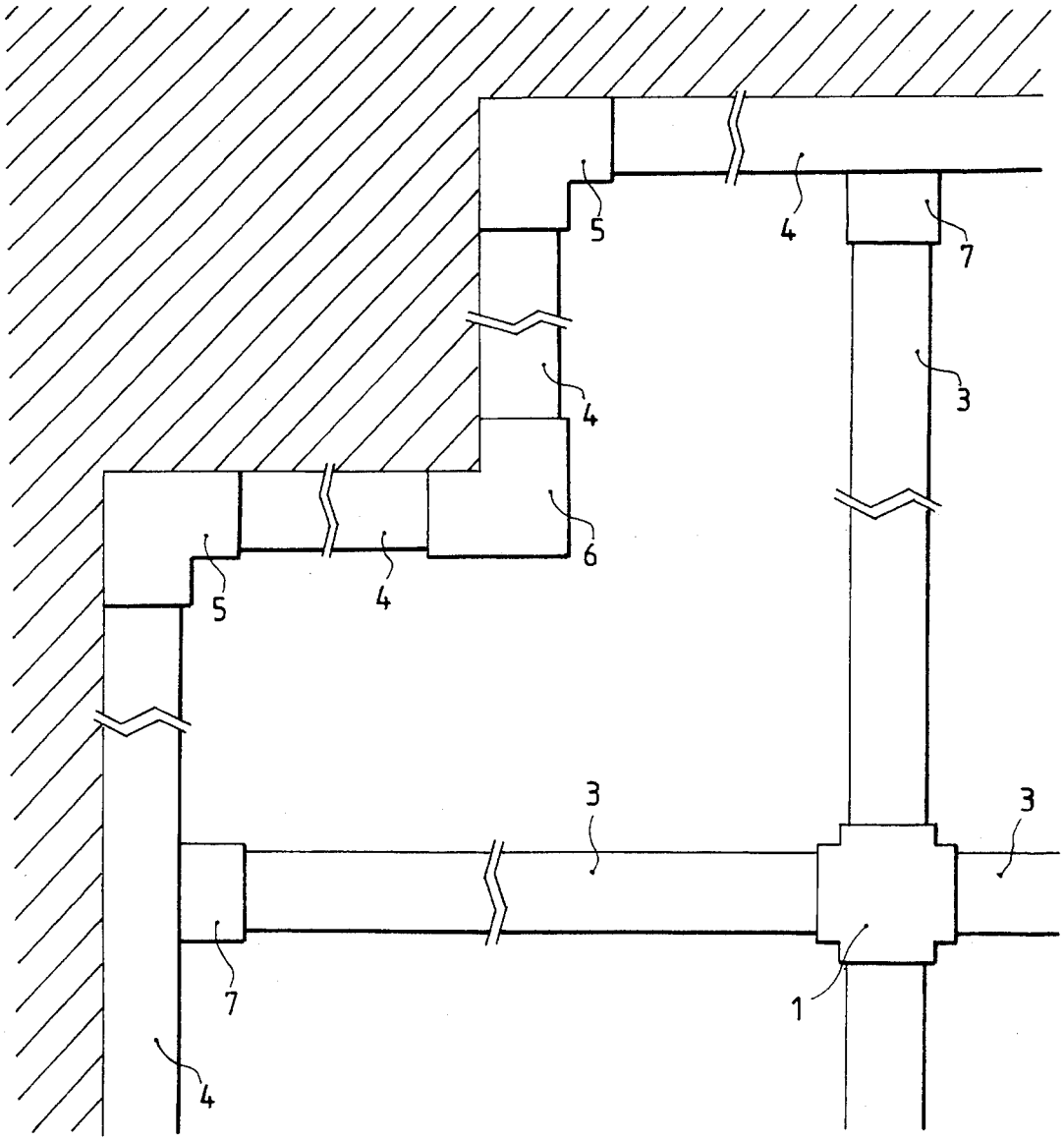
FIG, 9

VINYL CEILING GRID STRUCTURE

BACKGROUND OF THE INVENTION (a) Field of the Invention

The present invention relates to a vinyl ceiling frame structure, particularly to a suspended ceiling grid system in which one-way and two-way connecting members are integrally formed with plastics to cooperate with a partitioning board, and angled slats are provided on the ceiling wall to cooperate with an inner or an outer angled plates for extension. The end of the partitioning board can be attached to the receiving base so as to be able to connect to the angled slat quickly, forming the vinyl ceiling grid structure for ceiling panels support.

(b) Description of the Prior Art

The conventional ceiling mounting structure can generally be classified into two types: the first type is the tile ceiling in which the tiles or planks can be nailed onto the existing old ceiling, the second type is the suspended ceiling in which panels can be dropped into a grid system made out of light steel suspended below the old ceiling. The nail-on tile ceilings are not easy to take down and are not easy to maintain. In addition, wooden planks are usually used in those ceilings, they are easier to get rotted in a moisturized area. The grid system for the suspended ceilings are made out of metallic materials such as aluminum or light steel. Riveting and screwing connections are required during the installation. The cutting of the grid components are difficult and the installation is not easy, particularly when a beam or a column runs into the ceiling. In addition, the wood will rot and the metallic material will be rusty in a highly moist environment, especially in the bathroom where the decaying of the wood can be even more serious.

SUMMARY OF THE INVENTION

The main object according to the present invention is to provide a vinyl ceiling grid structure to replace the conventional grid structure made out of light steel. The structure uses a hollow partitioning board to cooperate with the integrally formed vinyl components such as the one-way and the two-way connecting members to form a grid structure in the ceiling so that the ceiling panels can be supported.

Another object according to the present invention is to provide a vinyl ceiling grid structure in which a L-shaped angled slat is used to cooperate with an inner or an outer angled plate so as to provide an extension of the angled slat, so that the partitioning board can be placed across for positioning.

A further object according to the present invention is to provide a vinyl ceiling grid structure in which a receiving base can be attached to the L-shaped angled slat so that the partitioning board can be assembled together, giving a ceiling-panel-support grid system which can be assembled quickly and efficiently.

BRIEF DESCRIPTION OF THE DRAWINGS

The drawings disclose an illustrative embodiment of the present invention which serves to exemplify the various advantages and objects hereof, and are as follows:

FIG. 2 is perspective fragmented view showing the one-way and the two-way connecting members according to the present invention.

FIGS. 3 is a perspective diagrammatic view showing the assembly of the angled slat with the inner angled plate of the present invention.

FIG. 4 is a perspective diagrammatic view showing the assembly of the angled slat with the inner angled plate of the present invention.

FIG. 5 is a perspective view of the angled slat according to the present invention.

FIG. 6 is a perspective view of the outer angled plate of the present invention.

FIG. 9 is a diagrammatic view showing an embodiment of the vinyl ceiling grid system according to the present invention.

DETAILED DESCRIPTION OF THE PREFERRED EMBODIMENT

Figure 1:
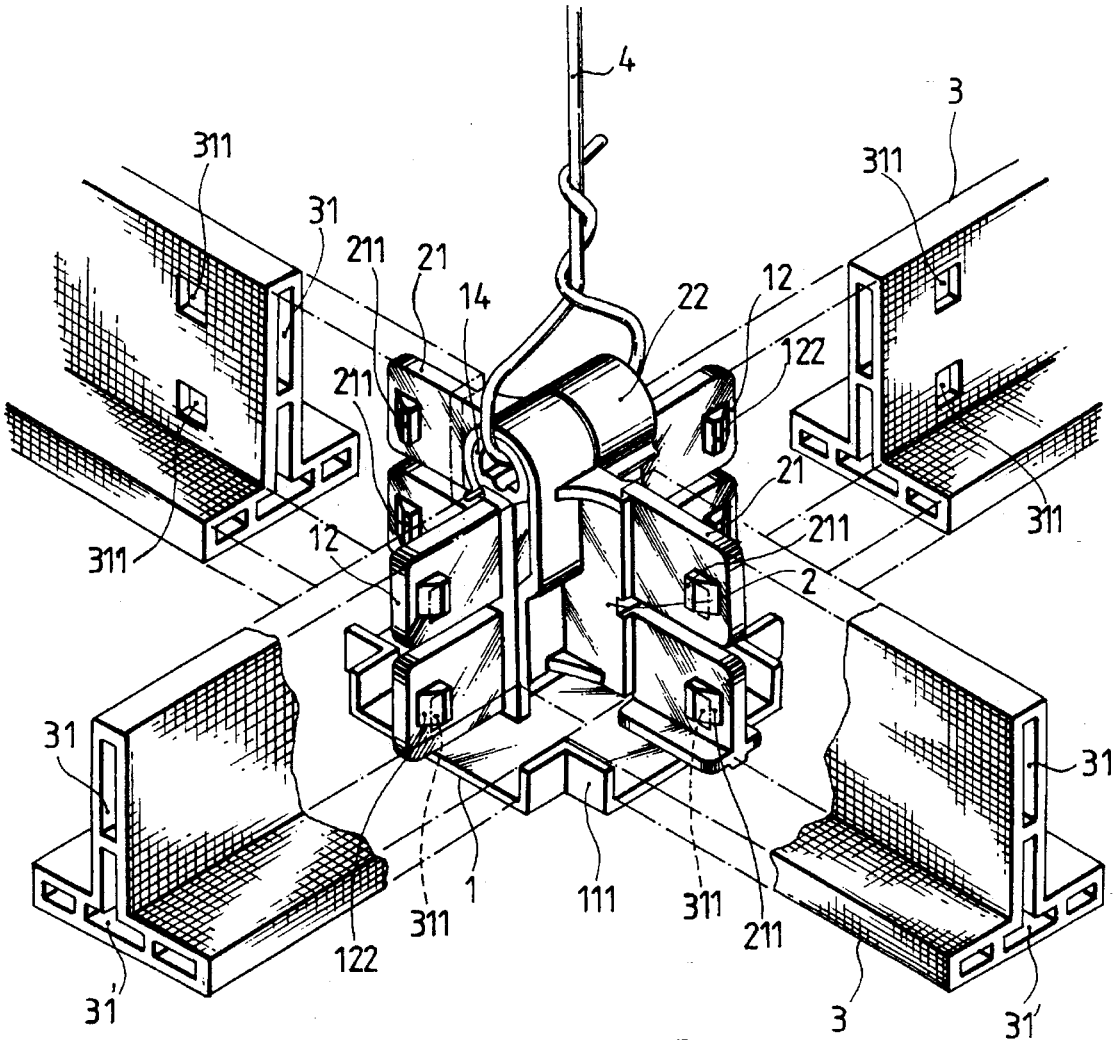
FIG. 1 is a perspective fragmented view showing the partitioning board, the one-way and the two-way connecting members according to the present invention.

As shown in FIGS. 1 and 2, the structure according to the present invention mainly consists of a two-way connecting member (1), a one-way connecting member (2) and a partitioning board (3). These components are assembled together according to the area of the ceiling to form a lattice frame for supporting the ceiling panels.

The two-way connecting member (1), as is shown in FIG. 2, consists of a base (11), on top of which is provided with an insert-to-fit plate (12). The plates (12) are standing vertically on the two edges of the base (11). The insert-to-fit plate (12) on each edge of the base (11) can be expanded to open to form a contiguous top and bottom insertion plates (121). In addition, the connecting portion (13) of the two insert-to-fit plates (12) is provided with a pipe section (14) in the lateral direction of its top. The lower part of the connecting portion (13) is provided with a hole (15). The four corners of the base (11) are cut out at right angles so that the base (11) has a substantially cross shape. Each of the four corners of the base (11) is provided with a L-shaped block wall (111).

The one-way connecting member (2) has an insert-to-fit plate (21) at one end and a curved latching portion (22) at the other end. The insert-to-fit plate (21) can also be expanded to open for insertion, as is shown in the embodiment in the figure. The bottom portion of the one-way connecting member (2) has an inverted 'T' shape, and the forward portion of the curved latching portion (22) is extended vertically to include a blocking plate (221). Moreover, the bottom portion of the curved latching portion (22) is stretched down vertically to a bent plate 222), one surface of which is extended to have a semi-circular projected column (223).

The partitioning board (3) is a hollow base having an inverted 'T' shape. A hollow chamber (31) is provided in the longitudinal direction of the partitioning board (3) so that the insert-to-fit plates (12) and (21) of the two-way and the one-way connecting members (1) and (2) can be fitted in. As is shown in the embodiment, the hollow chamber is also provided with adjacent upper and lower hollow chambers for receiving the insertion plates of the insert-to-fit plates (12) and (21) so that the latter can be secured therein by pressing. Thus, the hollow chamber 31' in the lower portion is formed into an inverted hollow 'T' shape for the insertion of the one-way and the two-way connecting members (1) and (2). It is worthwhile to point out that adhesives can be added to enhance the securing effects during the installation.

In the form illustrated, the curved latching portion (22) of the one-way connecting member (1) is used to clamp onto the pipe section (14) of the two-way connecting member (1). The curved latching portion (22) and its blocking plate (221) at the forward portion are used to secure the pipe section (14) in the lateral direction in place. The semi-circular projected column 223) provided is used to fit into the hole (15) of the two-way connecting member (1) so that the assembly can be precisely positioned. A steel wire (4) with a vinyl jacket is then fed through the lateral pipe section (14) and is securely mounted in an appropriate position. By such configuration, each of the hollow chamber (31) at one end of the partitioning board (3) is respectively inserted into the insert-to-fit plates (12) or (21) of the one-way or the two-way connecting members (1) and (2). An appropriate amount of adhesive is then applied so that the assembly can be held firmly together. Therefore, at the time of installation, a plurality of two-way connecting members are first provided, from which the one-way connecting members (2) and the partitioning boards (3) are then used to cooperate with each other so that a lattice structure for supporting the ceiling tile can be quickly formed and positioned.

In addition, the insert-to-fit plates of the one-way and the two-way connecting members have suitable width and length so that they can be adjusted based on the size of the partitioning boards. Hence, the assembly can be properly adjusted for sizing and positioning.

Since the two-way and the one-way connecting members (1) and (2) can be adjusted, the sizes of the partitioning boards (3) are therefore not restricted by the area of the ceiling. The sizes of the partitioning boards (3) can be standardized. (Such as the 2 meter or the 4 meter standard boards that are commonly used in the 2 meter square or the 4 meter square ceiling support.) Thus the assembling and the installation of the present invention are not affected by the area and the place of the installation. Moreover, the length of the partitioning boards (3) are not made to be very long, therefore, there is no concern that the partitioning boards (3) will deform or become loose, nor will there be any trouble in the transportation of the partitioning boards (3).

Figure 7:
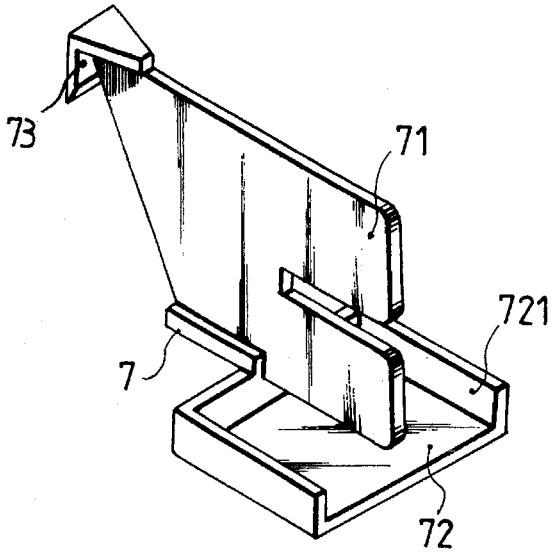
FIG. 7 is a perspective view of the receiving base of the present invention.
Figure 8:
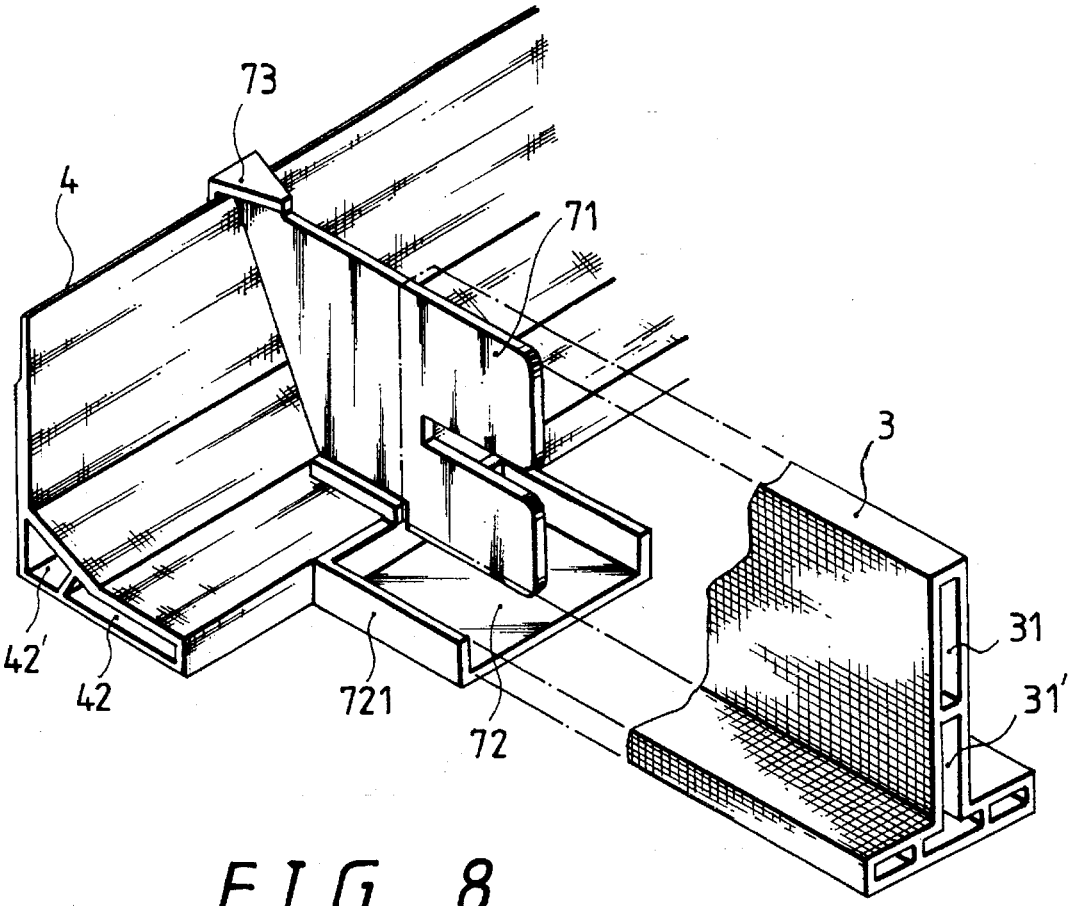
FIG. 8 is a perspective diagrammatic view showing the assembly of the angled slat, the receiving base and the partitioning board of the present invention.

Referring to FIGS. 3 and 4, which show the relationship of an angled slat (4), an inner angled plate (5) and an outer angled plate (5) of the invention. The assembly is installed on the wall. A receiving base (7) is provided for the attachment of the partitioning board (3), (as shown in FIGS. 7 and 8), so as to form the vinyl ceiling grid structure. As shown in FIG. 3, which shows an assembly of the angled slat (4) cooperating with the inner angled plate (6). The angled slat (4), as is shown in FIG. 5, is formed integrally by plastics to have a hollow 'L' shape. The vertical surface of the angled slat (4) has an appropriate thickness, which can be nailed and secured onto the wall. The bottom surface of the angled slat (4) is provided with an enforcement rib (41) so as to form two appropriate hollow chambers (42) and (42'). The intersection of the vertical surface and the base of the angled slat (4) forms a slanting surface (43), from which the structure of the L-shaped angled slat is strengthened. In addition, the inner angled plate (5) also has a 'L' shape, both ends of which are provided with two contiguous compatible plates (51). The edge on the inner corner is extended to a blocked wall (52). By configuring the above L-shaped angled slat (4) and the inner angled plate (5) together, the L-shaped angled slat (4) can first be nailed on one side of the wall. When the angled slat (4) along the wall runs into an inner corner, one end of the slat (4) can be cut accordingly, and the hollow chambers (42), (42') on the bottom surface can be fitted in tightly with the compatible plates (51) of the inner angled plate 5), allowing the two L-shaped angled slats (4) to turn around for extension with a perfectly fitted installation.

As is shown in FIG. 4, which shows an embodiment of the assembly of the L-shaped angled slat (4) that runs into an outer corner. Referring to FIG. 6, the outer angled plate (6) is a L-shaped plate having two contiguous, floating, compatible plates (61) at both ends. The edge on the outer corner is extended to a blocked wall (62). By use of the components of the outer angled plate 6), the L-shaped angled slat (4) can be made to turn when it runs into an outer corner. The blocked walls (62) of the outer angled plate (6) are placed to face outward to allow the two L-shaped angled slats (4) to fit in vertically, so that the corner extension of the installation is completed, as is illustrated in FIG. 4. This provides a thorough enclosed assembly without any breach.

As is shown in FIGS. 7 and 8, which show the receiving base (7) cooperating with the angled slat (4) and the partitioning board (3). One side of the receiving base (7) is provided with an insert-to-fit plate (71), which can be expanded to open from top and bottom, so that the upper and the lower hollow chambers (31), (31') on the longitudinal surface of the partitioning board (3) can be adapted to. Moreover, the lower portion of the insert-to-fit plate (71) of the receiving base (7) is provided with a connecting support board (72). The support board (72) has a blocked wall (721) around the edges except the outer edge, which has an opening. In addition, there is a latching plate (73) provided on the other side of the insert-to-fit plate (71) of the receiving base (7). The connection between the latching plate (73) and the main body is a slanted surface for latching onto the L-shaped angled slat (4), allowing the insert-to-fit plate (71) to be positioned facing outward. By such configuration, the partitioning board (3) can be inserted into the insert-to-fit plates (71) and the supporting board (72) of the receiving base (7) for a secured mounting. Moreover, the insert-to-fit plate (71) has a definite width and length which are adjustable, so that they can be adapted to fit the partitioning board (3) even when the dimension of the latter is off by a little bit. Glue can be applied appropriately to give a stable and secured installation.

As shown in FIG. 9, the present invention uses the integrally formed vinyl components including the two-way connecting member (1), the one-way connecting member (2), the partitioning board (3), the angled slat (4), the inner angled plate (5), the outer angled plate (6) and the receiving base (7) to form the vinyl ceiling frame structure. Since the sizes of the installation are different from one job to another, therefore, the selection of the above components is determined by the installer. For instance, for a smaller area with a rectangular shape, the two-way connecting member (1), the one-way connecting member (2), the partitioning board (3) and the L-shaped angled slat (4) can quickly be assembled. The receiving base (7) can be attached to the assembly, or the partitioning board (3) can be placed directly on the L-shaped angled slat (4). The inner angled plate (5) and the outer angled plate (6) can be used when the assembly needs to run through a corner during the installation.

In addition, the integration of the partitioning board (3) with the two-way connecting member (1) or the one-way connecting member (2) can also be accomplished by use of an adapting hole (311), which is provided in a corresponding position on the exterior wall of the hollow chamber (31) in the longitudinal direction of the partitioning board (3). Moreover, the insert-to-fit plates (12) or (21) of the one-way connecting member (1) or the two-way connecting member (2) are correspondingly provided with beveled latching blocks (122) or (211), as is shown in FIGS. 1 and 2. This way of fitting ensures a proper positioning and latching of the assembly, it also prevents the assembly from falling apart. Adhesive can then be applied to assure the secured bonding.

Although the invention has been described in its preferred form with a certain degree of particularity it is understood that the present disclosure of the preferred form has been made only by way of example and numerous changes in the details of construction and the combination and arrangement of parts may be resorted to without departing from the spirit and the scope of the invention as hereinafter claimed. It is intended that the patent shall cover, by suitable expression in the appended claims, whatever features of patentable novelty exists in the invention disclosed.

What is claimed is:

1. A vinyl ceiling grid structure comprising:

a first connecting member for connecting at least two partitioning boards, the first connecting members having a generally planar base with opposite sides and a plurality of first insert-to-fit plates located in a plane extending generally perpendicular to the base, the first insert-to-fit plates having distal ends extending towards opposite sides of the base, and a convex pipe section on an upper portion of the insert-to-fit plates extending in the plane of the first insert-to-fit plates.

2. The vinyl ceiling grid of claim 1 further comprising at least one partitioning board having a hollow chamber receiving an insert-to-fit plate so as to connect the partitioning board to the connecting member.

3. The vinyl ceiling grid of claim 2 wherein the partitioning board has an inverted "T" cross-sectional configuration.

4. The vinyl ceiling grid of claim 1 further comprising a second connecting member having second insert-to-fit plates and a concavely curved latching portion engaging the convex pipe section such that the second insert-to-fit plates extend generally perpendicular to the first insert-to-fit plates.

5. The vinyl ceiling grid of claim 1 wherein the base has a cruciform configuration.

6. The vinyl ceiling grid of claim 1 further comprising:

a) at least one partitioning board having opposite ends each with a hollow chamber, a first opposite end engaged with the first insert-to-fit plates;

b) at least one angled slat; and, c) a receiving base attached to the at least one angled slat and engaging the second opposite end of the partitioning board.

7. The vinyl ceiling grid of claim 6 wherein the receiving base comprises: a connecting support board; a third insert-to-fit plate configured to engage the hollow chamber of the at least one partitioning board; and a latching plate configured to engage the at least one angled slat.

8. The vinyl ceiling grid of claim 6 further comprising:

a pair of angled slats, each having hollow chambers; and an angled plate having a plurality of connecting plates thereon configured to engage the hollow chambers of the pair of angled slats so as to connect the angled slats together.

9. The vinyl ceiling grid of claim 8 wherein the connecting plates define an angle therebetween of approximately 90° such that the pair of angled slats extend approximately 90° to each other.

10. The vinyl ceiling grid of claim 6 wherein the at least one angled slat has a substantially "L" shaped cross-sectional configuration.

* * * * *